US006932717B2

(12) United States Patent
Hou et al.

(10) Patent No.: US 6,932,717 B2
(45) Date of Patent: Aug. 23, 2005

(54) GOLF CLUB HEAD

(75) Inventors: Wen-Ching Hou, Kaohsiung (TW); Chan-Tung Chen, Kaohsiung (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 0 days.

(21) Appl. No.: 10/698,479

(22) Filed: Nov. 3, 2003

(65) Prior Publication Data

US 2005/0096150 A1 May 5, 2005

(51) Int. Cl.[7] ..... A63B 53/04
(52) U.S. Cl. ..... 473/332; 473/349; 473/350
(58) Field of Search ..... 473/324, 329–332, 473/349–350, 342, 345; 273/DIG. 3, DIG. 8, DIG. 22

(56) References Cited

U.S. PATENT DOCUMENTS 3,970,236 A * 7/1976 Rogers ..... 228/196
4,398,965 A * 8/1983 Campau ..... 148/522
4,523,759 A * 6/1985 Igarashi ..... 473/346
5,492,327 A * 2/1996 Biafore, Jr. ..... 473/332
6,042,486 A * 3/2000 Gallagher ..... 473/329

* cited by examiner

*Primary Examiner*—Sebastiano Passaniti
(74) *Attorney, Agent, or Firm*—Birch, Stewart, Kolasch & Birch, LLP

(57) ABSTRACT

A golf club head includes a golf club head body, a striking plate mounted to a front side of the golf club head body, and a perimeter wall extending rearward along a perimeter of the golf club head body. At least one hole is defined in a toe of the perimeter wall to reduce the weight of the upper part of the golf club head body, thereby shifting the center of gravity of the golf club head downward toward the heel and thereby increasing the inertial moment of the golf club head.

17 Claims, 7 Drawing Sheets

GOLF CLUB HEAD

BACKGROUND OF THE INVENTION

1. Field of the Invention

The present invention relates to a golf club head. In particular, the present invention relates to a golf club head whose center of gravity can be adjusted.

2. Description of Related Art

FIG. 1 is a perspective view of a conventional golf club head. FIG. 2 is a sectional view of the golf club head in FIG. 1. FIG. 2*a* is an enlarged view of a circled portion in FIG. 2. The golf club head 1 is made of metal and includes a golf club head body 10, a striking plate 11, a perimeter wall 12, a hosel 13, and a vibration-absorbing plate 14. The striking plate 11 is mounted to a front side of the golf club head body 10 for striking a golf ball. The perimeter wall 12 is a wall that extends rearward along a perimeter of the golf club head body 10 and forms an opening 121 in a back of the golf club head body 10. A shaft (not shown) is engaged with the hosel 13. The vibration-absorbing plate 14 is made of rubber or carbon fiber and bonded by glue to a back of the striking plate 11 for absorbing vibrations generated as a result of striking a golf ball.

The upper part of the perimeter wall 12 and the hosel 13 have a considerable weight such that the center of gravity 15 of the golf club head 1 is in a relatively high position. This may result in a reduction in the inertial moment of the golf club head 1 and a decrease in the momentum-transferring efficiency from the striking plate to the golf ball as well as vibrations of the golf club head 1 while striking a golf ball. The striking effect and striking stability of the golf club head 1 are greatly and adversely affected.

As illustrated in FIG. 2*a*, if the striking plate 11 is mounted to an engaging portion 101 of the golf club head body 10 by welding, brazing, insertion, or pressing, an engaging edge 111 (such as a welding bead, an outflow of the material for brazing, an insertion area, or a pressing area) is formed in a joint area between the striking plate 11 and the golf club head body 10. When striking a golf ball, the resultant vibrations may cause a stress concentration around the engaging edge 111. The result of long-term stress concentration in the engaging edge 111 is cracks in the engaging edge 111, adversely affecting the structural strength of the golf club head 1. Although a vibration-absorbing plate 14 is bonded to the golf club head body 10, the bonding arrangement results in a gap 142 between the vibration-absorbing plate 14 and the golf club head body 10. The vibration-absorbing plate 14 could not absorb the concentrated stress due to existence of the gap 142; namely, the vibration-absorbing efficiency of the vibration-absorbing plate 14 is adversely affected by the gap 142.

OBJECTS OF THE INVENTION

An object of the present invention is to provide a golf club head with increased inertial moment and improved striking effect by means of providing a hole in a toe of a perimeter wall of the golf club head.

Another object of the present invention is to provide a golf club head having a reinforcing layer formed on a back of a striking plate by heat pressing or injection molding, thereby improving the structural strength, improving the vibration-absorbing effect, improving the striking stability, and improving the gripping comfort.

A further object of the present invention is to provide a golf club head that allows flexible adjustment of the position of the center of gravity by means of adjusting the specification, type, and number of the hole(s) in the golf club head.

Still another object of the present invention is to provide a golf club head includes a reinforcing layer formed on a back of a striking plate. The reinforcing layer has an extension covering and fixing a weight member, thereby simplifying the process for assembling the weight member.

SUMMARY OF THE INVENTION

In accordance with an aspect of the present invention, a golf club head includes a golf club head body, a striking plate mounted to a front side of the golf club head body, and a perimeter wall extending rearward along a perimeter of the golf club head body. At least one hole is defined in a toe of the perimeter wall to reduce the weight of the upper part of the golf club head body, thereby shifting the center of gravity of the golf club head downward toward the heel and thereby increasing the inertial moment of the golf club head.

A reinforcing layer is formed on a back of the striking plate to improve the structural strength, to improve the vibration-absorbing effect, to improve the striking stability, and to improve the gripping comfort.

Flexible adjustment of the position of the center of gravity can be achieved by means of adjusting the specification, type, and number of the hole(s) in the golf club head.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
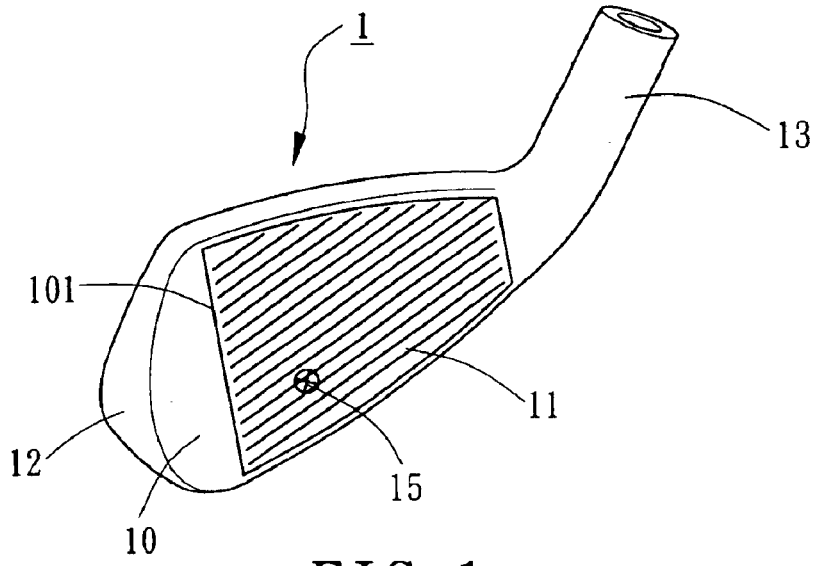
FIG. 1 PRIOR ART
FIG. 1 is a perspective view of a conventional golf club head.
Figure 2:
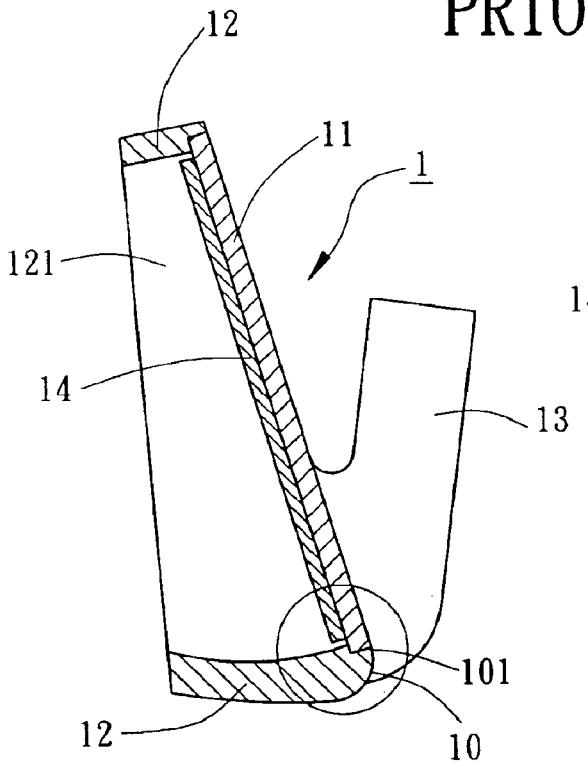
FIG. 2 PRIOR ART
FIG. 2 is a sectional view of the golf club head in FIG. 1.
Figure 2A:
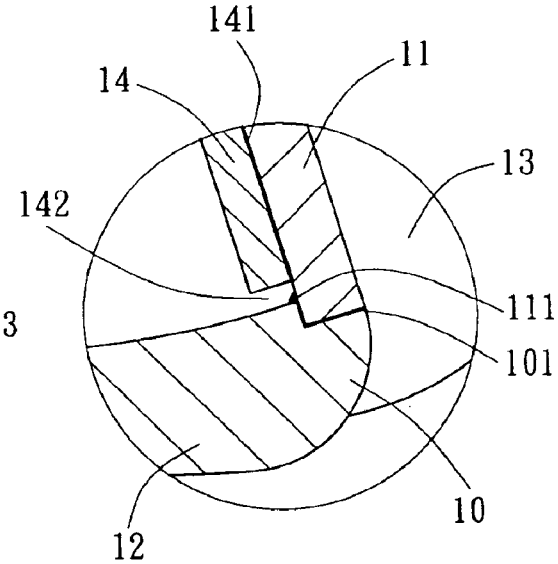
FIG. 2a PRIOR ART
FIG. 2*a* is an enlarged view of a circled portion in FIG. 2.

Preferred embodiments of the present invention are now to be described hereinafter in detail, in which the same reference numerals are used in the preferred embodiments for the same parts as those in the prior art to avoid redundant description.

Figure 3:
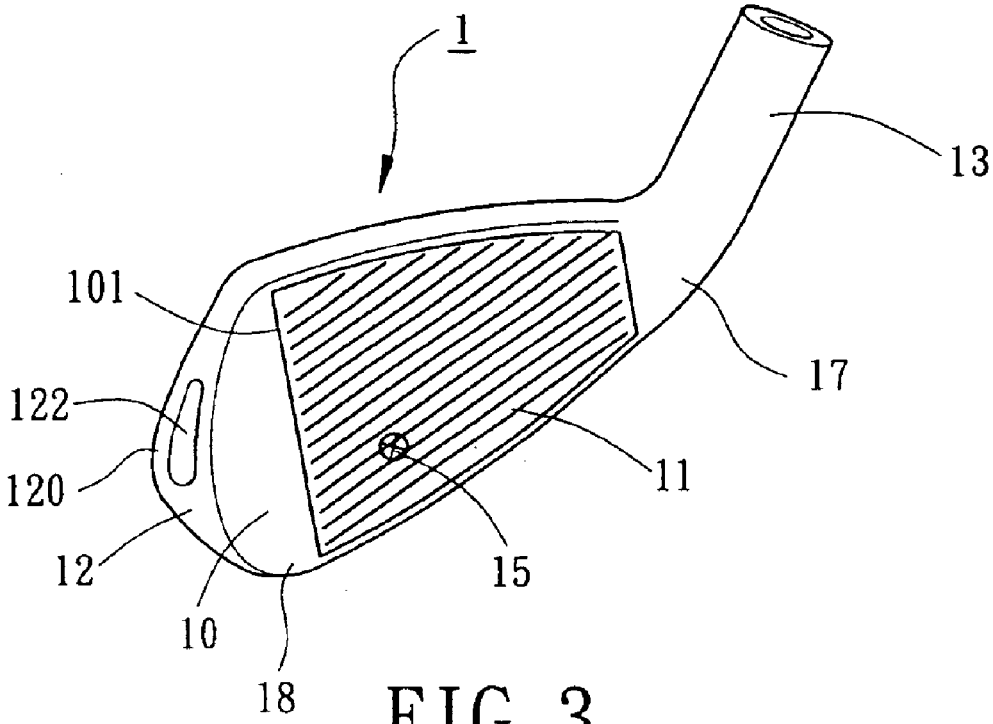
FIG. 3 is a front perspective view of a first embodiment of a golf club head in accordance with the present invention.
Figure 4:
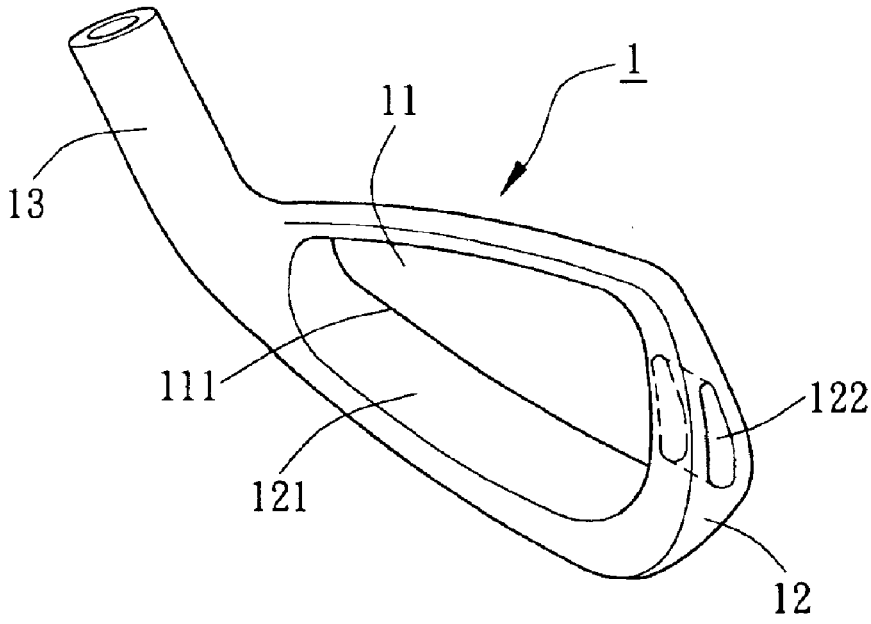
FIG. 4 is a rear perspective view of the golf club head in FIG. 3.
Figure 5:
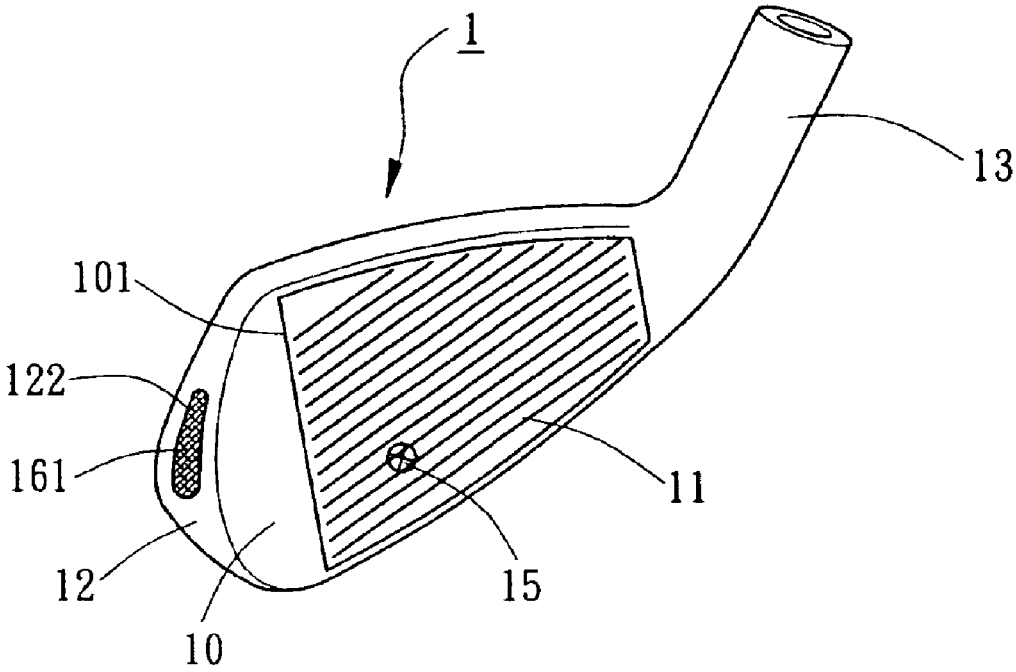
FIG. 5 is a front perspective view of a second embodiment of the golf club head in accordance with the present invention.
Figure 6:
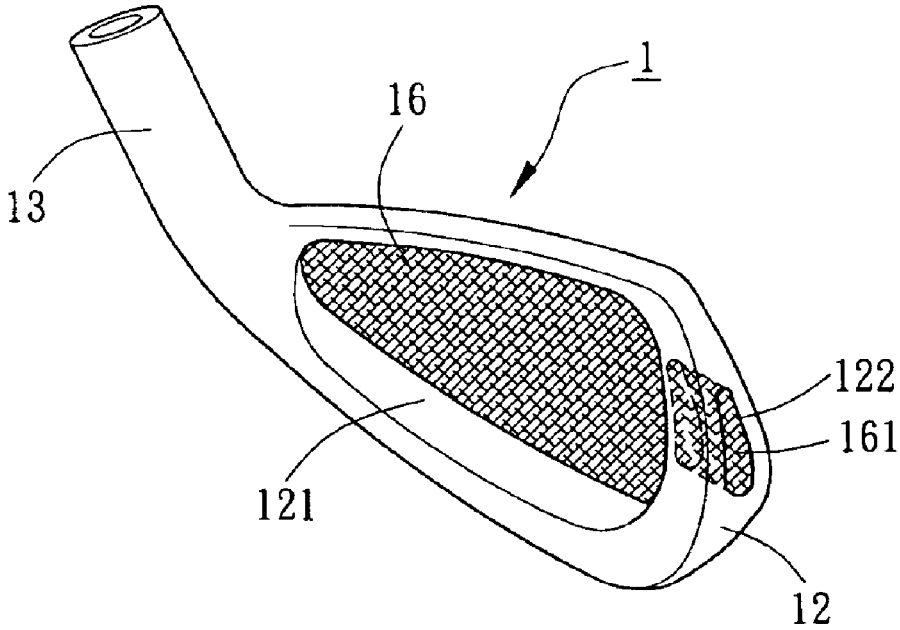
FIG. 6 is a rear perspective view of the golf club head in FIG. 5.

Referring to FIGS. 3 and 4, a first embodiment of a golf club head 1 in accordance with the present invention includes a golf club head body 10 having an engaging portion 101 on a front side thereof. A striking plate 11 is mounted to the engaging portion 101 of the front side of the golf club head body 10 for striking a golf ball. The striking plate 11 can be mounted to the engaging portion 101 of the golf club head body 10 by insertion, pressing, brazing, welding, and screwing. Alternatively, the striking plate 11 can be directly and integrally formed on the golf club head body 10.

A perimeter wall 12 extends rearward along a perimeter 18 of the golf club head body 10 and defines an opening 121 in a back of the golf club head body 10. A hosel 13 is formed on a side of the golf club head body 10 and engaged with a shaft (not shown). A hole 122 is defined in a toe 120 of the perimeter wall 12 to reduce the weight of the upper part of the perimeter wall 12 and the weight of the toe 120, thereby shifting the center of gravity 15 of the golf club head 1 downward toward the heel 17 and thereby increasing the inertial moment of the golf club head 1. The striking effect of the golf club head 1 is improved, i.e., the flying distance of the golfball stricken by the golf club head 1 is increased. Preferably, the hole 122 is a through-hole and extends from an inner face (not labeled) of the perimeter wall 12 through an outer face (not labeled) of the perimeter wall 12. The golf club head body 10 (excluding the striking plate 11) can be integrally formed by means of precision casting, casting, mechanical processing, pressure-casting, forging, or injection molding. Alternatively, the golf club head body 10 can be made by means of section-by-section engagement.

FIGS. 5 through 7*a* illustrate a second embodiment of the golf club head in accordance with the present invention. In this embodiment, a reinforcing layer 16 is formed on a back of the striking plate 11 to improve the structural strength of the striking plate 11 and to support the string plate 11. The reinforcing layer 16 is a layer of light and reinforced material directly engaged on the back of the striking plate 11 via the hole 122 or the opening 121. A reinforcing block 161 extends from the reinforcing layer 16 and fills the hole 122 to provide an aesthetic appearance for the golf club head 1. The reinforcing block 161 is integrally formed with the reinforcing layer 16 as a single member. Preferably, the reinforcing layer 16 and the reinforcing block 161 are made by means of heat pressing or injection molding. The light material is preferably selected from a group consisting of carbon fibers, resins (such as epoxy resins), high molecular polymer materials, rubber, light alloys (such as titanium alloys or aluminum alloys), and adhesive composite powders thereof. The reinforcing layer 16 can be tightly bonded to the back of the striking plate 11, no adhesive is required, as the reinforcing layer 16 is bonded to the back of the striking plate 11 by means of heat pressing or injection molding.

Figure 7:
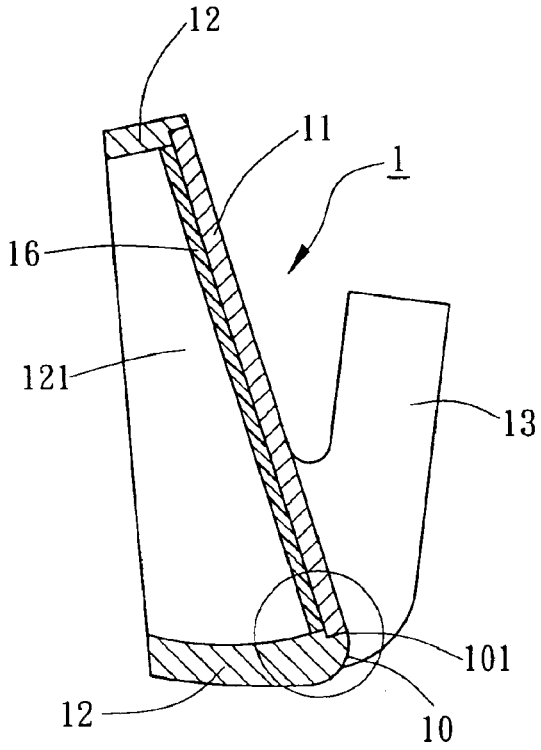
FIG. 7 is a sectional view of the golf club head in FIG. 5.
Figure 7A:
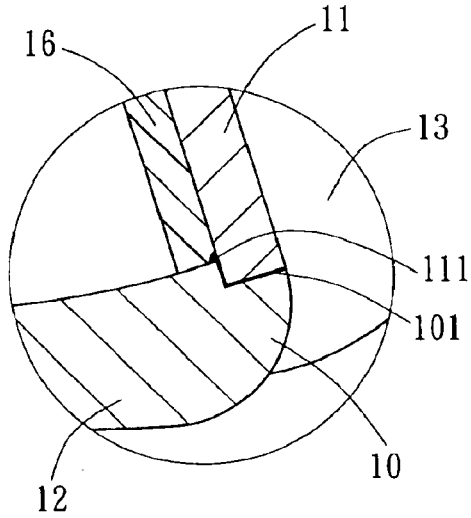
FIG. 7*a* is an enlarged view of a circled portion in FIG. 7.

As illustrated in FIG. 7*a*, an engaging edge 111 (such as a welding bead, an outflow of the material for brazing, an insertion area, or a pressing area) formed in a joint area between the striking plate 11 and the golf club head body 10 is completely covered by the reinforcing layer 16. Thus, when striking a golf ball, the stress concentrated on the engaging edge 111 can be absorbed by the reinforcing layer 16, avoiding generation of cracks in the engaging edge 111 as a result of long-term stress concentration on the engaging edge 111. The engaging relationship between the striking plate 11 and the golf club head body 10 is improved, and the life of the golf club head 1 is prolonged. Further, since a perimeter of the reinforcing layer 16 is in intimate contact with an inner wall face of the golf club head body 10, the reinforcing layer 16 not only directly absorbs the resultant vibrations of the striking plate 11 that strikes a golf ball but also absorbs the vibrations of the front side of the golf club head 10 and of the perimeter wall 12. As a result, the reinforcing layer 16 not only provides the golf club head 1 with improved structural strength and improved vibration-absorbing effect but also improves the striking stability and the gripping comfort of the golf club head 1.

Figure 8:
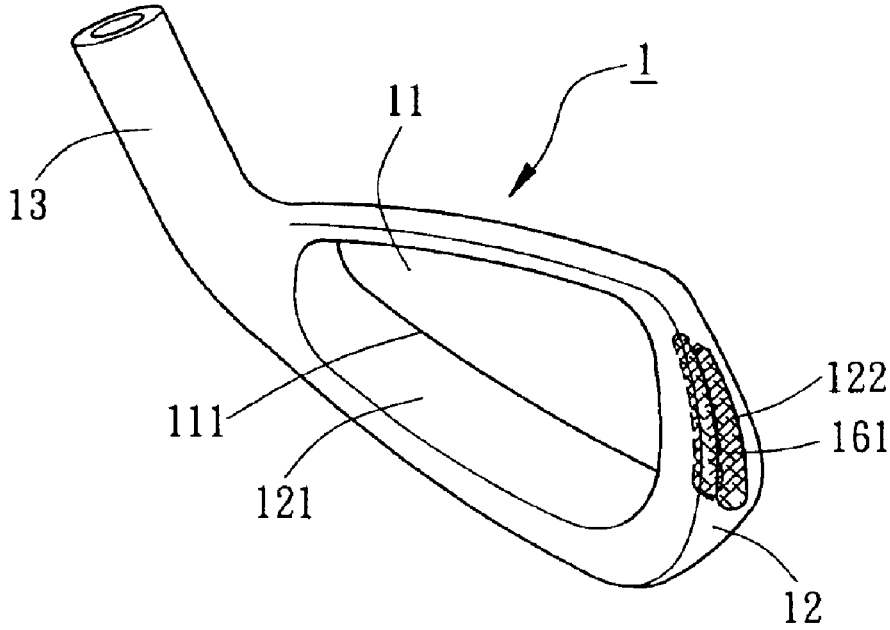
FIG. 8 is a rear perspective view of a third embodiment of the golf club head in accordance with the present invention.

FIG. 8 illustrates a third embodiment of the golf club head in accordance with the present invention. In this embodiment, the hole 122 is a blind hole that has an opening in an outer face (not labeled) of the perimeter wall 122. By means of adjusting the specification and type of the hole 122 in the golf club head 1 (e.g., increasing the size of the hole 122), the weight of the upper part and the weight of the toe of the golf club head 1 are varied. This allows flexible adjustment of the position of the center of gravity 15. Thus, provision of the hole 122 increases the inertial moment of the golf club head and improves the striking effect of the golf club head 1 (i.e., increases the flying distance of the golf ball stricken by the golf club head 1). Further, the reinforcing block 161 that fills the hole 122 can be formed by means of heat pressing or injection molding, providing an aesthetic appearance for the golf club head 1.

Figure 9:
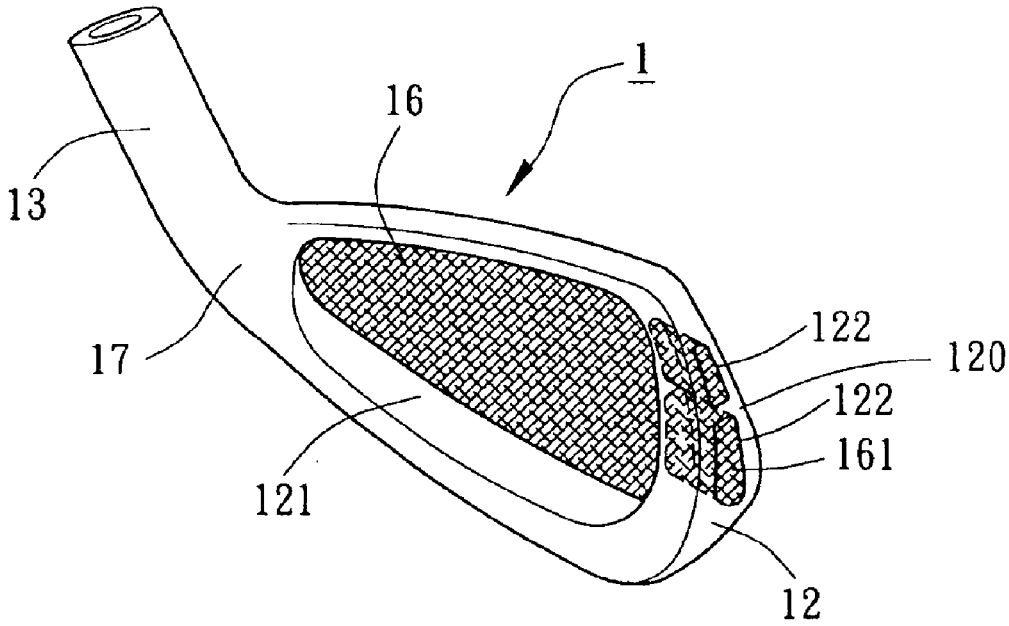
FIG. 9 is a rear perspective view of a fourth embodiment of the golf club head in accordance with the present invention.

FIG. 9 illustrates a fourth embodiment of the golf club head in accordance with the present invention that is modified from the second embodiment. In this embodiment, the toe 120 of the perimeter wall 12 includes a pair of holes 122 adjacent to each other. Each hole 122 is preferably a through-hole. A reinforcing layer 16 is preferably formed by heat pressing or injection molding on the back of the striking plate 11. Further, a reinforcing block 161 is preferably formed by heat pressing or injection molding in each hole 122. Thus, provision of the holes 122 reduces the weight of the upper part of the perimeter wall 12 and the weight of the toe 120, shifting the center of gravity 15 of the golf club head 1 downward toward the heel 17, increasing the inertial moment of the golf club head 1, improving the striking effect of the golf club head 1 (i.e., increasing the flying distance of the golf ball stricken by the golf club head 1), improving the striking stability of the golf club head 1, and improving the gripping comfort of the golf club head 1.

Figure 10:
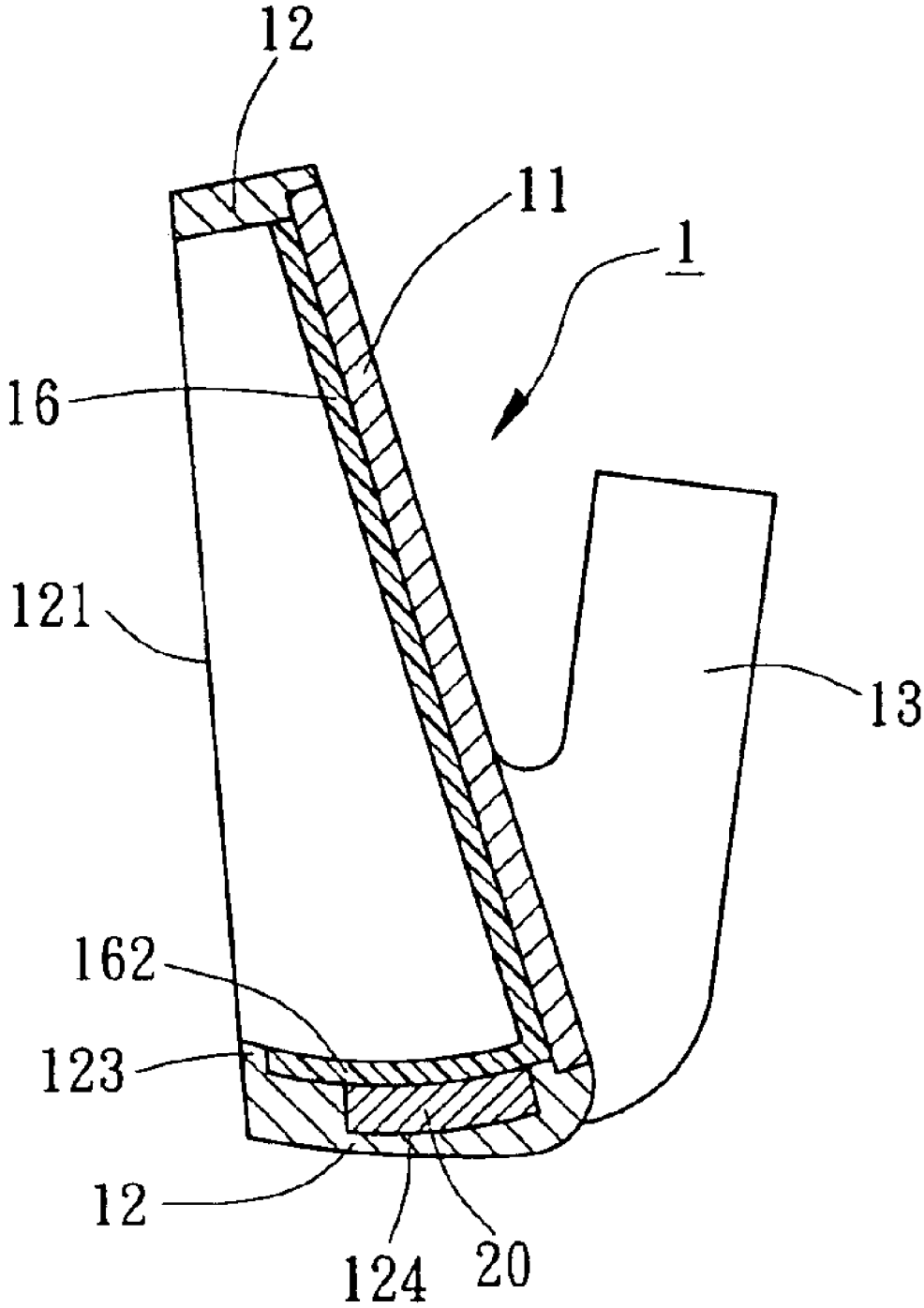
FIG. 10 is a sectional view of a fifth embodiment of the golf club head in accordance with the present invention.

FIG. 10 illustrates a fifth embodiment of the golf club head in accordance with the present invention that is modified from the second embodiment. In this embodiment, a lower end of the reinforcing layer 16 has an extension 162 that extends rearward along a bottom portion of the inner face of the perimeter wall 12. The perimeter wall 12 includes a flange 123 that projects inward from a rear end of the bottom portion of the inner face of the perimeter wall 12, and a compartment 124 is defined in a bottom portion of the inner face of the perimeter wall 12. A weight member 20 is mounted in the compartment 124 for adjusting the center of gravity 15 of the golf club head 1.

In assembly, the weight member 20 is firstly mounted in the compartment 124, and the reinforcing layer 16 and the extension 162 are formed by heat pressing or injection molding, with a rear end of the extension 162 being in intimate contact with an inner face of the flange 123. The flange 123 prevents the reinforcing layer 16 and the extension 162 from disengaging from the opening 121 of the golf club head 1. Further, the extension 162 directly buries and fixes the weight member 20, simplifying the assembling process of the weight member 20. Further, the specification and composition of the weight member 20 can be varied according to the product need.

Figure 11:
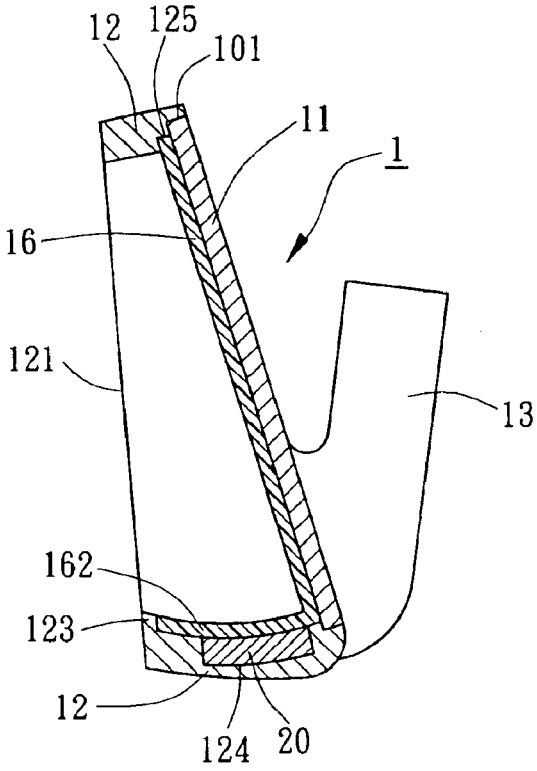
FIG. 11 is a sectional view of a sixth embodiment of the golf club head in accordance with the present invention.

FIG. 11 illustrates a sixth embodiment of the golf club head in accordance with the present invention that is modified from the fifth embodiment. In this embodiment, the golf club head 1 includes a groove 125 contiguous to a rear side of the engaging edge 111 and defined in an upper portion and two side portions of the inner face of the perimeter wall 12. The groove 125 receives an edge of the reinforcing layer 16, increasing the bonding strength of the reinforcing layer 16 and preventing the reinforcing layer 16 from peeling off while supporting the reinforcing layer 16 and the striking plate 11. The overall structural strength, the shock-absorbing effect, the striking stability, and the gripping comfort are improved.

Figure 12:
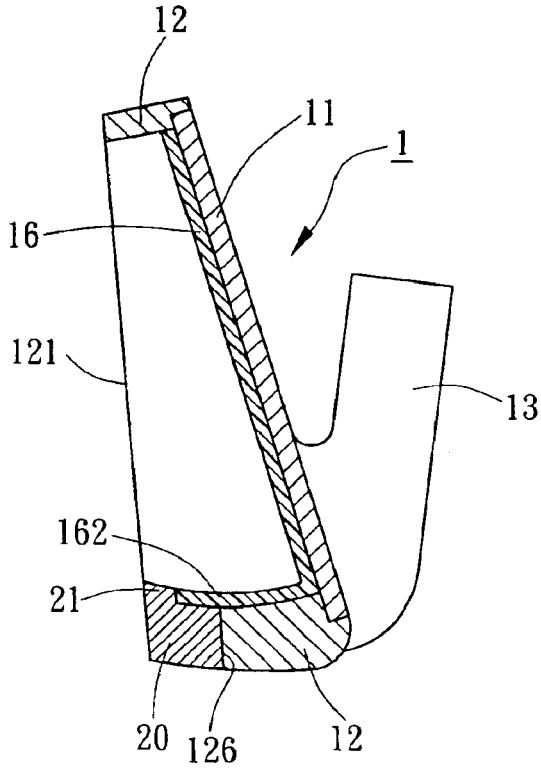
FIG. 12 is a sectional view of a seventh embodiment of the golf club head in accordance with the present invention.

FIG. 12 illustrates a sixth embodiment of the golf club head in accordance with the present invention that is modified from the fifth embodiment. In this embodiment, a notch 126 is defined in a bottom portion of the perimeter wall 12 for engaging with a weight member 20. The weight member 20 can be engaged in the notch 126 by means of welding, brazing, or screwing. Further, the weight member 20 has a flange 21 that extends inward toward the opening 121. Thus, the distal end of the extension 162 is directly and tightly engaged with the inner face of the flange 21. As a result, the flange 21 prevents the reinforcing layer 16 and the extension 162 from disengaging from the opening 121. The weight member 20 can be used to adjust the center of gravity of the golf club head 1. The specification and composition of the weight member 20 can be varied according to the product need.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a golf club head body including a front side, a rear cavity having an opening at a rear side of the golf club head, and a perimeter, a striking plate being adapted to be mounted to the front side of the golf club head body;

a perimeter wall extending rearward along the perimeter of the golf club head body and including a toe;

at least one weight-adjusting hole provided in the toe of the perimeter wall to thereby adjust a weight of an upper part of the golf club head body and a weight of the toe, thereby shifting a center of gravity of the golf club head toward a heel of the golf club head body and thereby increasing an inertial moment of the golf club head, the weight-adjusting hole being in communication with the rear cavity of the golf club head body;

a reinforcing block mounted in the weight-adjusting hole and made of a light material, the reinforcing block being provided with a structural strength for structurally reinforcing the weight-adjusting hole and absorbing vibrations generated from the perimeter wall as a result of striking a golf ball; and a reinforcing layer mounted to a rear surface of the striking plate for permitting deformation of the striking plate and connected with the reinforcing block, the reinforcing layer and the reinforcing block commonly reinforcing structural strength of the rear surface of the striking plate and absorbing vibrations generated from the striking plate as a result of striking the golf ball.

2. The golf club head as claimed in claim 1, wherein said weight-adjusting hole is a through-hole.

3. The golf club head as claimed in claim 1, wherein said weight-adjusting hole is a blind hole having an opening in said rear cavity proximate to the toe of the perimeter wall.

4. The golf club head as claimed in claim 1, wherein the reinforcing block is formed by one of heat pressing and injection molding.

5. The golf club head as claimed in claim 1, wherein the light material is selected from a group consisting of carbon fibers, resins, high molecular polymer materials, light alloys, and rubber.

6. The golf club head as claimed in claim 1, wherein the reinforcing layer is formed by one of heat pressing and injection molding.

7. The golf club head as claimed in claim 1, wherein the light material is selected from a group consisting of carbon fibers, resins, high molecular polymer materials, light alloys, rubber, and adhesive composite powders thereof.

8. The golf club head as claimed in claim 1, wherein the striking plate is engaged to the golf head body by means of one of welding, brazing, insertion, pressing, and screwing, further including an engaging edge in a joint area between the back of the striking plate and an inner face of the perimeter wall, the reinforcing layer completely covering the engaging edge to absorb stress concentrated on the engaging edge during striking of a golf ball.

9. The golf club head as claimed in claim 8, wherein the inner face of the perimeter wall includes a groove contiguous to the engaging edge between the golf club head body and the striking plate, the groove receiving an edge of the reinforcing layer to improve bonding strength of the reinforcing layer.

10. The golf club head as claimed in claim 1, wherein the reinforcing layer has an extension extending rearward, the extension being tightly engaged with a bottom portion of an inner face of the perimeter wall.

11. The golf club head as claimed in claim 10, wherein the perimeter wall includes a flange extending inward from a rear end of the bottom portion of the inner face thereof, the flange preventing the reinforcing layer and the extension from peeling off.

12. The golf club head as claimed in claim 10, wherein the bottom of the perimeter wall includes a compartment, a weight member being recieved in the compartment and being buried and fixed by the extension of the reinforcing layer.

13. The golf club head as claimed in claim 1, wherein the perimeter wall includes a notch in a bottom thereof, a weight member being engaged in the notch.

14. The golf club head as claimed in claim 13, wherein the weight member includes a flange extending inward toward an opening delimited by the perimeter wall.

15. The golf club head as claimed in claim 1, wherein the perimeter wall is a single piece.

16. The golf club head as claimed in claim 15, wherein the reinforcing layer fails to occupy the entire rear cavity.

17. The golf club head as claimed in claim 1, wherein the reinforcing layer fails to occupy the entire rear cavity.

* * * * *